United States Patent [19]

Sease

[11] Patent Number: 4,731,960

[45] Date of Patent: Mar. 22, 1988

[54] MOLDING STRIP ASSEMBLY WITH REVEAL AND SHELVING SYSTEM FOR USE IN CONSTRUCTING FLEXIBLE WALL COVERINGS

[76] Inventor: R. Gregg Sease, 6457 S. Heritage Pl., West, Englewood, Colo. 80111

[21] Appl. No.: 903,672

[22] Filed: Sep. 4, 1986

[51] Int. Cl.[4] ..... A47B 5/00

[52] U.S. Cl. ..... 52/36; 52/222; 52/273; 160/392

[58] Field of Search ..... 52/36, 145, 222, 273, 52/716, 36, 584; 160/392-395, 327, 371

[56] References Cited

U.S. PATENT DOCUMENTS

| | | | |
|---|---|---|---|
| 1,772,780 | 8/1930 | Milone | 160/371 |
| 3,232,395 | 2/1966 | La Barge | 52/762 |
| 3,657,850 | 4/1972 | Billarant | 52/762 |
| 3,783,931 | 1/1974 | Assael | 160/392 |
| 4,018,260 | 4/1977 | Baslow | 160/227 |
| 4,053,008 | 10/1977 | Baslow | 160/392 |
| 4,197,686 | 4/1980 | Baslow | 160/327 |
| 4,625,490 | 12/1986 | Baslow | 52/222 |

FOREIGN PATENT DOCUMENTS

| | | | |
|---|---|---|---|
| 134429 | 9/1949 | Australia . | |
| 964830 | 3/1975 | Canada . | |
| 2231824 | 1/1973 | Fed. Rep. of Germany . | |
| 2228923 | 12/1974 | France | 52/222 |
| 2339501 | 8/1977 | France | 160/392 |

*Primary Examiner*—James L. Ridgill, Jr.

*Attorney, Agent, or Firm*—Timothy J. Martin

[57] ABSTRACT

A molding strip assembly is provided for use in covering a support surface with a flexible material and is particularly adapted for retaining facing interior marginal edges of a pair of material panels within the interior of a framework which surrounds the area to be covered on the support surface. The molding strip assembly has a base wall to be positioned adjacent the support surface and first and second raised support walls along opposite lateral sides of the base wall. The support walls are oriented and supported in spaced relation above the support surface. Preferably, first and second interior side walls extend between the base wall and the first and second raised support walls, respectively, to define a U-shaped channel region; first and second outer side walls extend downwardly from the first and second raised support walls, respectively, and terminate in outwardly turned attachment flanges for securing the strip to the support surface. The first and second interior side walls are each separated into upper and lower portions, and a pair of resiliently biased clamping walls are formed between each upper and lower portion so that the marginal edge of each flexible panel may be trained over a respective support wall and forced between the respective pair of clamping walls to be retained by the molding strip. A reveal element may then be lockably inserted to close the U-shaped channel. Special reveal elements and bracket assemblies may also be employed to attach shelving to the molding strip and, thus, the support surface.

28 Claims, 12 Drawing Figures

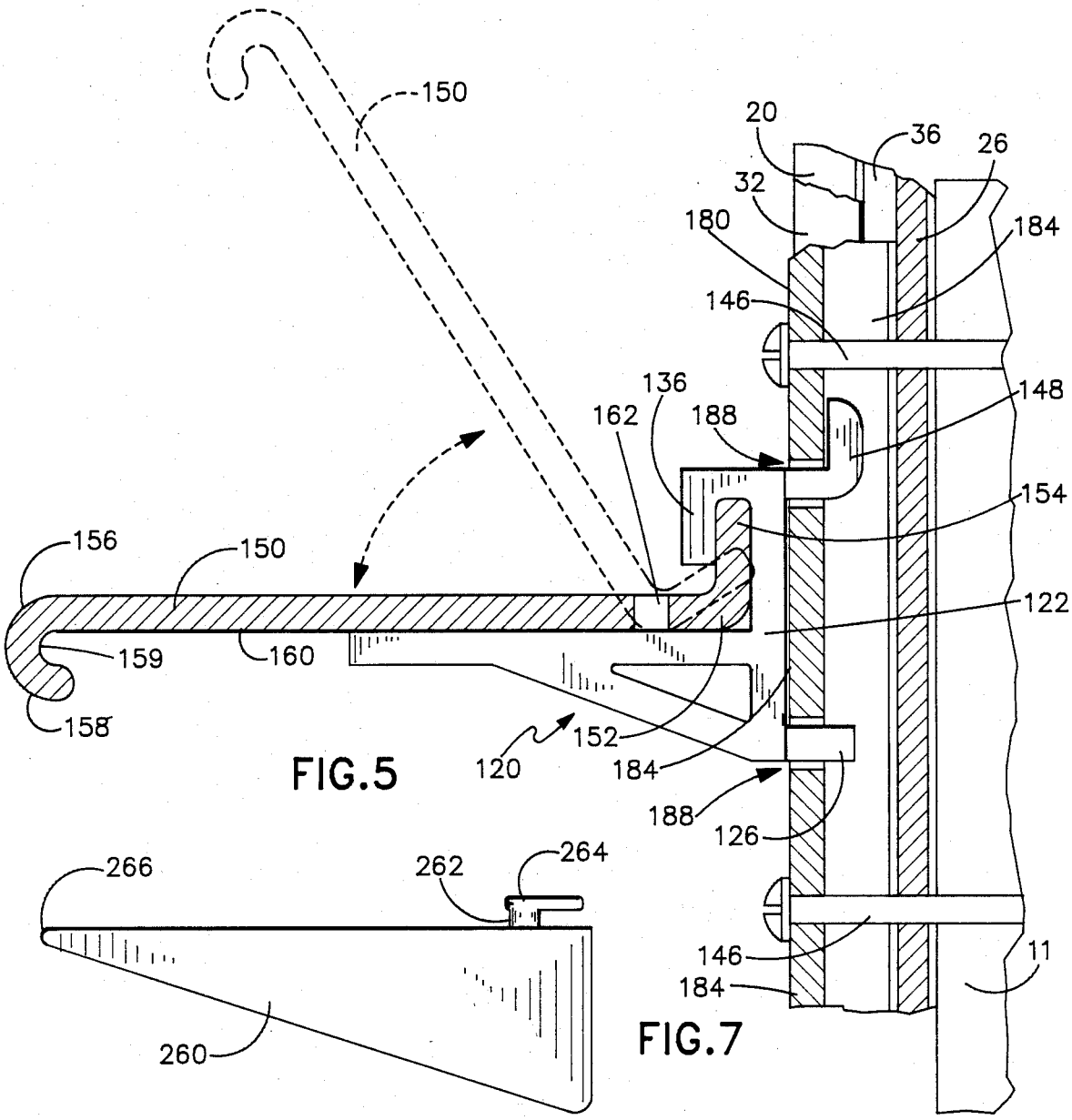
FIG.5
FIG.7
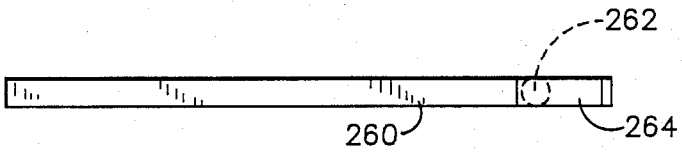
FIG.8
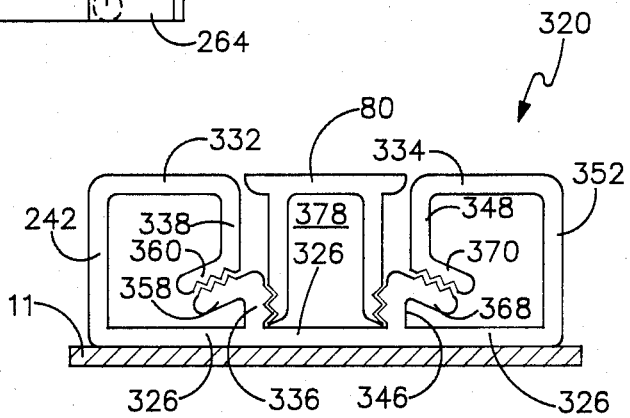
FIG.12

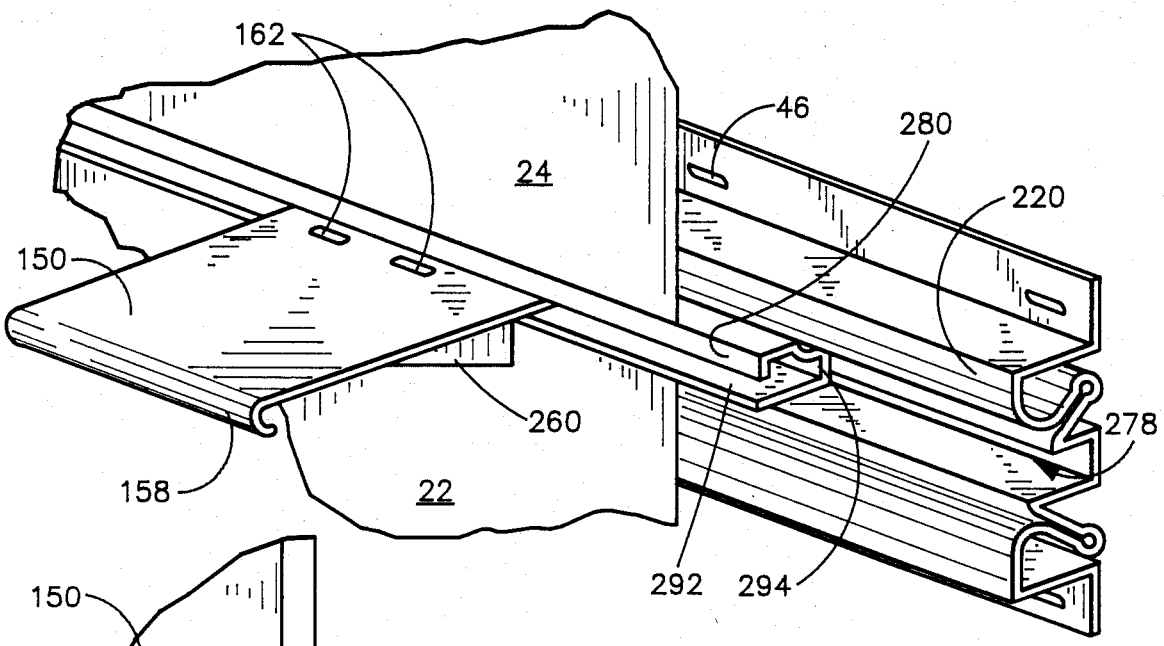
FIG.6
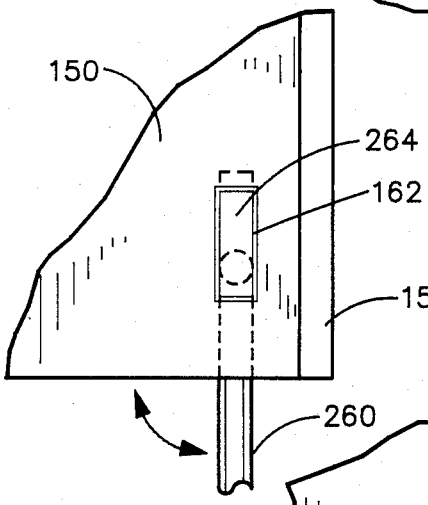
FIG.9
FIG.10
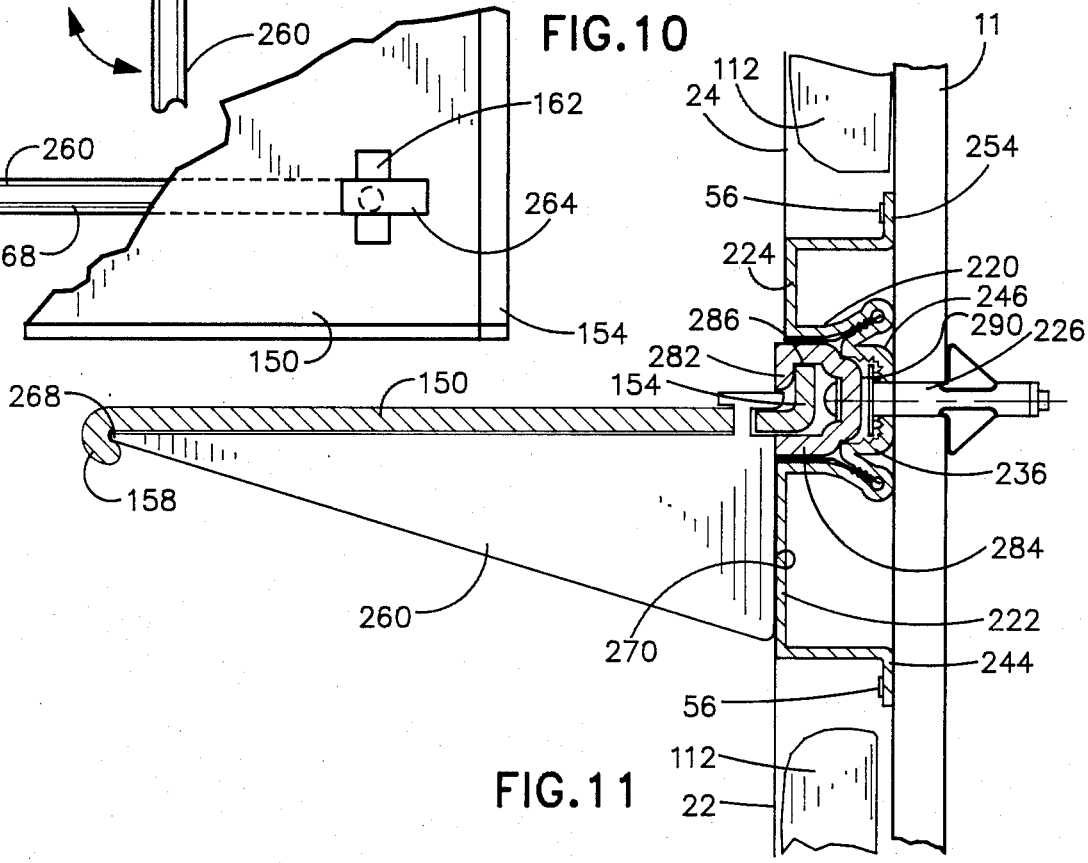
FIG.11

MOLDING STRIP ASSEMBLY WITH REVEAL AND SHELVING SYSTEM FOR USE IN CONSTRUCTING FLEXIBLE WALL COVERINGS

BACKGROUND OF THE INVENTION

The present invention relates to the attachment of flexible coverings to a support surface, such as a wall and the like. Specifically, the present invention is directed toward a molding strip assembly which has a decorative reveal between two sheets of material so that the decorative reveal enhances the appearance of the wall covering system. The molding strips according to the present invention are particularly adapted to be interior material support strips which are attached to the support surface within a perimeter of an area to be covered. These molding strip pieces can, however, be used as perimeter defining support strips for the flexible covering. As such, the present invention is particularly adapted to be used in conjunction with my currently pending application entitled ASSEMBLY OF MOLDING STRIPS ADAPTED TO MOUNT FLEXIBLE COVERINGS ON SUPPORT SURFACES, Ser. No. 841,593, filed Mar. 20, 1986.

Flexible wall coverings, such as fabric coverings, have been showing increasing popularity in recent times even though flexible coverings have been used for many years. The use of flexible coverings for support surfaces, such as walls and the like, has become even more desirable since thermal and accoustical materials can be incorporated into the covering system. As was noted in my earlier application, above-referenced, designers desire increasing flexibility in presenting asthetic coverings so that they may achieve different "looks" in their wall coverings. The present invention is adapted to allow a designer increased variation in the look that can be obtained by a flexible wall covering. At the same time, the present invention contemplates incorporating shelving systems onto a flexible wall covering system.

In the prior art, there are basically two techniques used to mount flexible coverings over support surfaces. One technique utilizes an adhesive that relatively permanently adheres the flexible covering to the support surface such in the manner of wallpaper. The second technique is a framework mounting strip where moldings extend around and across the area to be covered.

Most modern improvements to flexible wall coverings are directed toward this second technique and, it is the second of these techniques to which the present invention is directed. In addition to the above-referenced application, other framework systems for mounting have been disclosed. One such example is shown in the pending application entitled MOLDING STRIPS AND ASSEMBLY THEREOF FOR MOUNTING A FLEXIBLE COVERING ONTO A SUPPORT SURFACE, Ser. No. 705,796, filed Feb. 26, 1985 by the inventor of the present application. The following patents also show framework systems for mounting a flexible covering to a support surface, such as a wall:

| Patent No. | Inventor | Country | Issue Date |
|---|---|---|---|
| 1,772,780 | Milone | U.S. | Aug. 12, 1930 |
| 3,657,850 | Billarant | U.S. | Apr. 25, 1972 |
| 3,783,931 | Assael | U.S. | Jan. 08, 1974 |
| 4,018,260 | Baslow | U.S. | Apr. 19, 1977 |
| 4,053,008 | Baslow | U.S. | Oct. 11, 1977 |

-continued

| Patent No. | Inventor | Country | Issue Date |
|---|---|---|---|
| 4,197,686 | Baslow | U.S. | Apr. 15, 1980 |
| 964,830 | Tombu | Canada | Mar. 25, 1975 |
| 2,339,501 | Benbaron | France | Aug. 26, 1977 |
| 134,429 | Boeing Aircraft Co. | Australia | Sep. 26, 1949 |
| 2,231,824 | Tombu | Germany | Jan. 18, 1973 |

With the exception of my co-pending application, Ser. No. 705,796, none of the above systems disclose molding strip assemblies having a decorative reveal structure which permits design flexibility. Furthermore, none of these issued patents or pending applications disclose a system allowing the attachment of shelving systems directly to the molding strip assembly that supports the flexible wall covering.

Although these prior art structures accomplish the broad objective of mounting a flexible fabric or covering to a wall, there remains a need for a molding strip assembly that it is easy to install yet which permits a designer even greater flexibility in selecting the appearance to be achieved. There is a further need for such a system that is easy to install which can readily compete with existing systems but which incorporates additional functional features not heretofor available.

SUMMARY OF THE INVENTION

It is an object of the present invention to provide a novel molding strip which is useful for attaching flexible sheets of material onto a support surface.

It is a further object of the present invention to provide a molding strip assembly which permits design flexibility in attaching flexible sheets of material onto a support surface.

It is a still further object of the present invention to provide a molding strip having a decorative reveal which increases design flexibility of wall covering systems and which decorative reveal may be used to attach shelving as part of the wall covering system.

Accordingly, the present invention directed to a molding strip assembly which is attachable to a support surface, such as a wall, and which includes structure for attaching flexible sheets to the support surface. To this end, a molding strip is provided which has base wall that is positioned against the support surface which may receive fastening elements to secure the base wall thereto. A first raised support wall is operatively connected to the base wall so that it is laterally offset along one edge of the base wall and is positioned in spaced relation above the support surface. A second raised support wall is also operatively connected to the base wall and is laterally offset along a second side edge of the base wall and is supported in spaced relation above the support surface. Preferably, the two raised support walls are oriented in a substantially common plane. A first material retaining means, preferably in the form of a pair of clamping walls, are located between the first support wall and the first side edge of the base wall, and a second material retaining means, again preferably a second pair of clamping walls, located between the second support wall and the base wall.

Each of the retaining means operate to retain a marginal edge of a flexible sheets of material. In the preferred form of the invention, as noted above, the first and second material retaining means preferably include a first and second pairs of clamping walls. Each of these pairs of clamping walls are resiliently biased against one another so that the marginal edge of a fabric sheet may be forced in between the clamping walls to be held in position with the sheet of material then extending out of the clamping walls, over the support wall and trained along the support wall to be held in spaced relation to the support surface. Each pair of clamping walls may have facing, matable serrations to facilitate the clamping of material between the clamping walls. Each of the raised support walls may be operatively held in position by pairs of side wall portions including a lower side wall portion and an upper side wall portion extending between the base wall and its respective support wall. This structure then forms a wide, open U-shaped channel; the base wall forms the bottom of the channel, and the side wall portions form the sides of the channel. The raised support walls then project laterally outward of the channel, one support wall on each side thereof. The pairs of clamping walls are located intermediate of the side wall portions and project laterally outwardly on opposite sides of the channel structure. These side wall portions may, in the preferred form of the invention, define interior side walls, and first and second outer side walls may be provided respectively for the first and second raised support walls. Each of these outer support walls project downwardly from its respective support wall to terminate at an edge generally in the plane of the base wall. Laterally outwardly projecting flanges may extend away from each outer side wall, again in the same plane as the base wall, and define attachment flanges for the structure to facilitate the attachment of the molding strip to the support surface.

In order to enhance the decorative appeal of the above described structure, a reveal element may be matably received in the U-shaped channel structure formed by the interior side wall portions and the base wall. This reveal element may have first and second reveal side wall portions respectively engaging the first and second interior side walls, and matable serrations may be provided between the reveal side walls and the molding strip interior side walls where the reveal element is positively engaged by the molding element. The reveal element then includes a top wall that extends across the side walls, at an upper end thereof, so that the top wall substantially encloses the U-shaped structure. Preferably, the top wall of the reveal element is located in a generally common plane with the first and second support walls.

The reveal element provide several structural variations according to the present invention. In one variation, the reveal element may be provided with decorative material that covers the exposed surface of the top wall where this material may be customized to compliment the flexible sheets of material to be mounted by the molding element to the support surface. Another variation includes a reveal element having a plurality of spaced openings which mount a bracket having a back plate with mounting elements formed thereon spaced for insertion into the openings and a support arm extending outwardly of the back plate to support a shelf. The bracket may include a hooked lip which projects away from the back plate which hooked lip engages a hooked edge on the shelf to further mount the shelf on the bracket. A third variation includes a reveal element that has a bottom wall extending between the first and second reveal side wall portions and a top wall extending from one of the side walls of the reveal toward the other to define a lip and an opening into the interior of the reveal element. A shelf is then provided with a hooked edge that is insertable into the reveal element to engage the lip, and the shelf mounts a plurality of brackets which abut or bears against one of the support walls of the molding strip when the shelf hooked edge is inserted into the reveal element.

These and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 5 is a side view in partial cross-section showing the reveal element and bracket of FIG. 4 attached to the support surface and molding strip for supporting a shelf;

FIG. 6 is a perspective view of a modified molding strip and a second modified reveal element according to the present invention;

FIG. 7 is a side view in elevation of a shelf bracket adapted for use with the assembly shown in FIG. 6;

FIG. 8 is a top plan view of the shelf bracket shown in FIG. 7;

FIG. 9 is a top plan view showing the initial position in coupling of the shelf bracket shown in FIGS. 7 and 8 to a shelf;

FIG. 10 shows the final mated coupling between the shelf bracket and shelf shown in FIG. 9;

FIG. 11 is a cross-sectional view of the molding strip, reveal element and shelf and bracket assembly shown in FIG. 6; and FIG. 12 is a cross-sectional view of a third embodiment of a molding strip according to the present invention.

DETAILED DESCRIPTION OF THE PREFERRED EMBODIMENT

The present invention is directed to a molding strip assembly which is useful for attaching flexible sheets of material to a support surface. As such, the present invention is particularly adapted for use in mounting fabrics to walls as an alternative to other wall coverings. This molding strip assembly according to the preferred embodiment of the present invention is especially constructed to permit greater flexibility in design so that a designer may achieve different "looks" in wall coverings using this system. In addition, the present invention includes the capability of mounting shelves so that with the molding strip structure thereby expands the functional utility of systems for covering walls.

Figure 1:
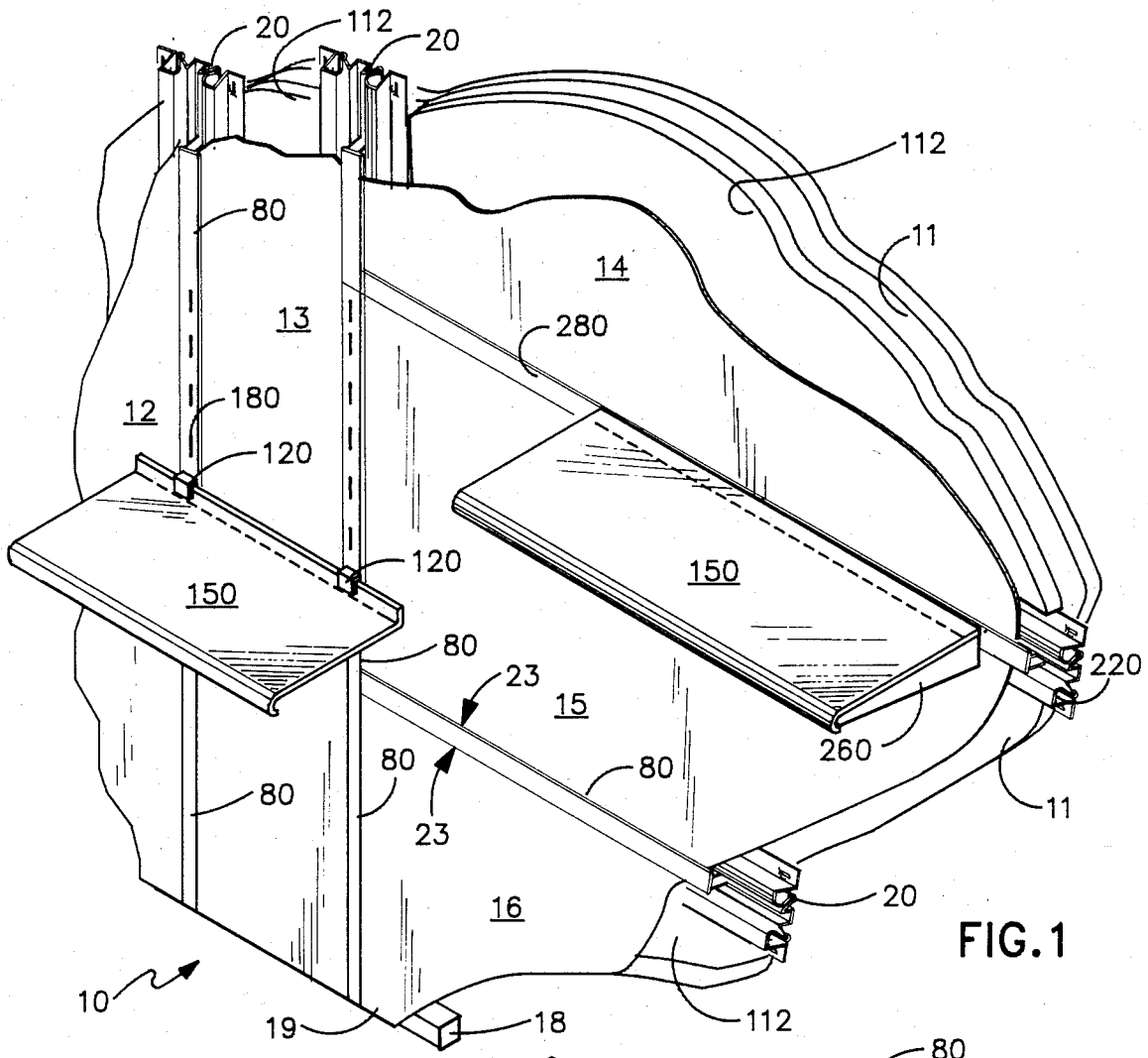
FIG. 1 is a cut-away view in perspective showing the molding strip assembly attaching five panels of flexible material to a support surface and showing the two types of molding strips, shelves and brackets according to the present invention.

As is shown in FIG. 1, the wall covering system according to the present invention may be used to form a representative wall covering 10 which is mounted over a support surface or wall 11. As such, the present invention is particularly constructed for use with outer molding strips, such as strip 18, configured as a framework over an area of the support surface to be covered. Strip 18 may be manufactured according to my pending application, Ser. No. 841,593, or other systems known in the art. In wall covering system 10, a plurality of inner molding strips 20 according to the preferred embodiment of the present invention receive reveal elements 80 and 180 and a modified molding strip 220 receives modified reveal element 280. Molding strips 20 and 220 mount five sheets of flexible material such as fabric sections or panels 12, 13, 14, 15 and 16 so that these panels are positioned in spaced relation to wall 11. Some of these panels have perimeter marginal edge portions for attachment to the framework, and all of these panels have at least one interior marginal edge for attachment to respective molding strips 20. For example, in FIG. 1, panel 16 has a perimeter marginal edge portion at 19 and an interior marginal edge portion at 21 which face interior marginal edge portion 23 of panel 15. Shelves 150 are mounted onto reveals 180 and 280 supported by their respective brackets 120 and 260, as described below.

Figure 2:
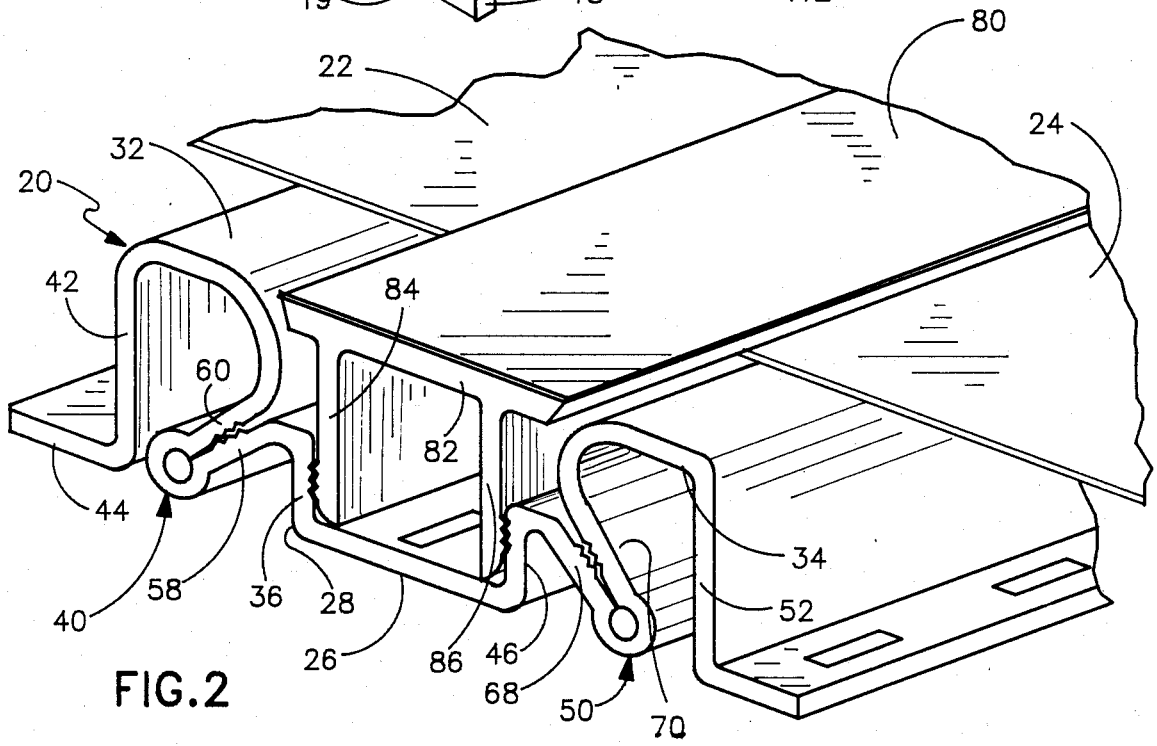
FIG. 2 is a perspective view of the preferred embodiment of the preferred molding strip assembly showing the reveal element in a locked position with the molding strip securring the marginal edges of two sheets of flexible material.
Figure 3:
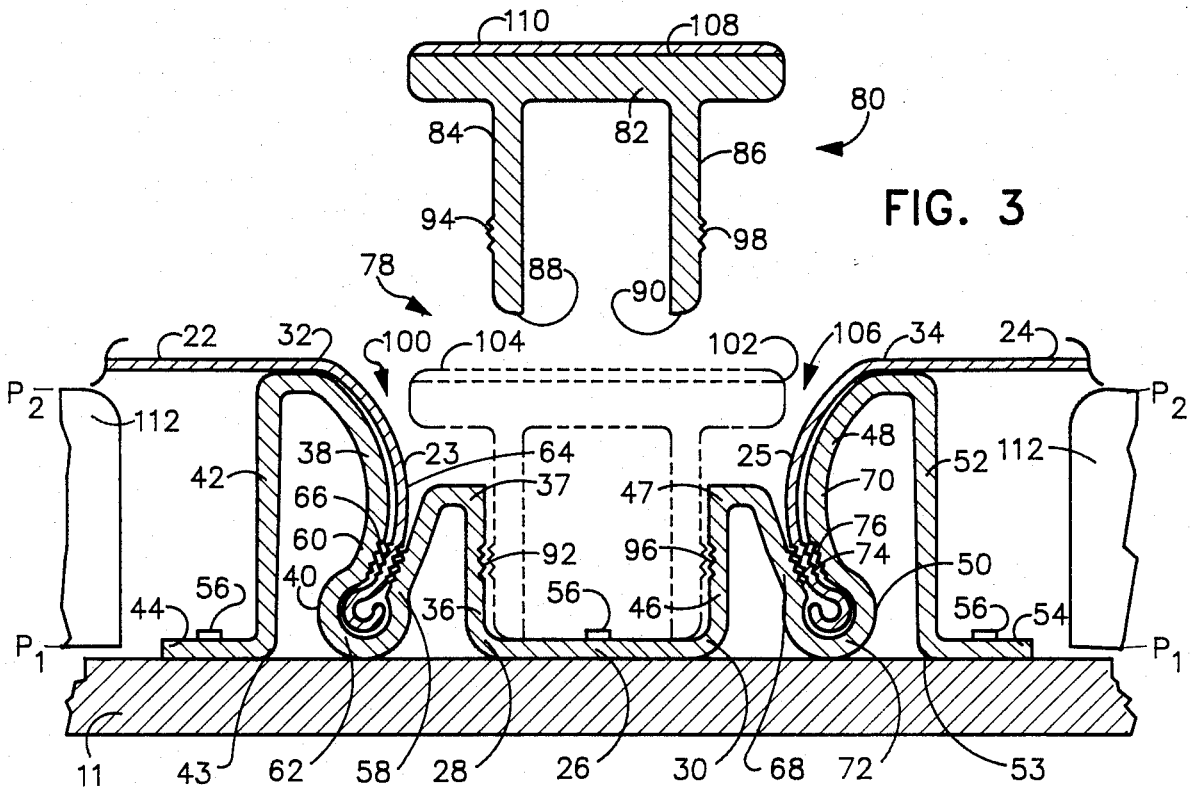
FIG. 3 is a side view in cross-section of a molding strip and reveal elements shown in FIG. 2 with the reveal element shown in position for locking engagement with the molding strip and with the reveal element shown in phantom in the engaged position.

The structure of the preferred embodiment of the inner molding strip and reveal assembly best shown in FIGS. 2 and 3 wherein molding strip 20 mateably and lockably receives reveal element 80 and retains the marginal edges of first and second fabric sheets 22 and 24. Molding strip 20 broadly includes a base wall 26 that is adapted to be positioned against the support surface, such as wall 11 shown in FIG. 3. A first raised support wall 32 is operatively connected to base wall 26 and is laterally offset from a side edge 28 of the base wall and is supported in spaced relation above the wall 11. A second raised support wall 34 is operatively connected to base wall 26 and is laterally offset from a second side edge 30 of base wall 26 so that it is supported in spaced relation above wall 11. Preferably, support walls 32 and 34 are oriented in a common plane $P_2$ which is parallel to the plane $P_1$ of base wall 26. It should be appreciated, though, that the relative orientation of base wall 26 and support walls 32 and 34 could be adjusted to provide design flexibility for the wall covering.

In the preferred form of the present invention, first raised support wall 32 is operatively positioned and supported by a first lower side wall portion 36 and a first upper side wall portion 38 which are interconnected by means of a clamping structure 40 that defines a retaining means for marginal edge portion 23 of fabric sheet 22. First lower side wall portion 36 and first upper side wall portion 38 define a first interior side wall that supports first support wall 32 in spaced relation to support surface 11. An outer side wall 42 extends downwardly from support wall 32 to an edge 44 adjacent wall 11. A flange 44 projects laterally outwardly from edge 43 in plane $P_1$ to provide an additional mounting structure to attach molding element 20 to wall 11. First flange 44 and first outer side wall 42 further support and position support wall 32.

Similarly, second raised support wall 34 is operatively interconnected and supported by a second lower side wall portion 46 and a second upper side wall portion 48 which are interconnected to one another by means of a clamping structure 50. Second lower side wall portion 46 and second upper side wall portion 48 define a second interior side wall supporting support wall 34. A second outer side wall 52 extends downwardly from support wall 34 to an edge 53, and a second laterally outwardly projecting flange 54 extends outwardly from second outer side wall 52 in plane $P_1$ at edge 53. Flange 54 and outer side wall 52 support and position the second support wall 34. It should thus be appreciated that mounting element 20 may be fixed to support surface 11 by means of various attaching elements such as staples 56, which may be placed through either of flanges 44 and 54 or through base wall 26, as is shown in FIG. 3.

Clamping structures 40 and 50 are each formed similarly by a pair of clamping walls. As is shown in FIGS. 2 and 3, clamping structure 40 includes a clamping wall 58 and a clamping wall 60 which are positioned in abutting relation and which are interconnected along an edge thereof by means of arcuate wall portion 62. The edge of clamping wall 58 opposite arcuate portion 62 is connected to an upper edge 37 of lower side wall portion 36. Clamping wall 60 extends from arcuate wall portion 62 and is connected to first upper side wall portion 38. The abutting surfaces of clamp walls 58 and 60 are provided with mating serrations 64 and 66, respectively, wherein a form of ribbed teeth that engage one another. It should further be appreciated that arcuate wall portion 62 maintains clamping walls 58 and 60 into a resiliently biased abutting relation.

Likewise, clamping structure 50 is formed by a second pair of clamping walls, including clamping wall 68 and clamping wall 70 which are interconnected along an edge by arcuate wall portion 72. The edge of clamping wall 68 opposite arcuate portion 72 is connected to an upper edge 47 of second lower side wall portion 46. Clamping wall 70 extends from arcuate wall portion 72 and is connected to second upper side wall portion 48. The interior abutting surfaces of clamping walls 68 and 70 are provided with mating serrations 74 and 76, respectively, which are preferably in the form of rib-like teeth which mateably engage one another. To this end, arcuate wall portion 72 resiliently biases clamping walls 68 and 70 into abutting relation so that their mating serrations are engaged.

In the preferred form of the present invention, molding strip 20 is formed as an integral extruded piece of plastic which is polyvinylchloride, nylon or other suitable plastic material. Such material is relatively rigid, but has some resilient give so that clamping walls 58 and 60 as well as clamping walls 58 and 70 may be slightly spread apart to allow forceably insertion of marginal edge 23 of first fabric sheet 22 between clamping walls 58 and 60. Similarly, clamping walls 68 and 70 may be deflected slightly to allow forceable insertion of marginal edge 25 of fabric sheet 24 between clamping walls 68 and 70. The resilient biasing then locks the marginal edges of sheets 22 and 24 between the respective clamping walls of clamping structures 40 and 50. To this end, then, fabric sheet 20 extends from clamping structure 40, along side wall portion 38 and is then trained across first support wall 32. Likewise, fabric sheet 24 extends from clamping structure 50, along side wall portion 48 and is then trained across second support wall 34.

As noted above, side wall portions 36 and 38 define a first interior side wall while side wall portions 46 and 48 define a second interior side wall. The two interior side walls, along with base wall 26, thus configure a U-shaped channel structure 78. Decorative reveal element 80 is received in channel structure 78, if desired. As shown in FIG. 3, the side wall portions 38 and 48 are spaced apart a further distance from one another than are lower side wall portions 36 and 46. Reveal element 80 includes a top wall 82 from which downwardly projects first and second reveal side walls 84 and 86. Reveal side walls 84 and 86 extend substantially perpendicularly from top wall 82 and are in parallel relation to one another. Reveal side walls 84 and 86 are spaced apart slightly less than the distance between first and second lower side wall portions 36 and 46.

When reveal element 80 is inserted into U-shaped channel region 78, as is shown in phantom in FIG. 3, the lower ends 88 and 90, respectively, of reveal side walls 84 and 86 terminate adjacent base wall 26 and abut first and second lower side wall portions 36 and 46, respectively. This mounted configuration is shown best in FIG. 2. Further, to facilitate a positive engagement of reveal element 80 and molding strip 20, the facing surfaces of side wall 84 and first lower side wall portion 36 are provided with mating serrations 92 and 94, respectively. Likewise, the facing surfaces of lower side wall portion 46 and the outer surface of reveal side wall 86 are provided with serrations 96 and 98. When reveal element 80 is inserted into U-shaped channel structure 78, serrations 92 engage serrations 94 and serrations 96 engage serrations 98 to snap-lock the pieces together. Serrations 92, 94, 96 and 98 are preferably in the form of elongated rib teeth.

As noted above, upper side wall portions 38 and 48 are spaced apart further than are lower side wall portions 36 and 46. Accordingly, in order for reveal element 80 to substantially enclose U-shaped structure 78, top wall 82 is wider than the spacing of reveal side walls 84 and 86. When inserted into U-shaped channel structure 78, top wall 82 has edges 100 and 102 which are adjacent upper side wall portions 38 and 48 in plane $P_2$ so that small gaps 104 and 106 allow the passage of marginal edge portions 23 and 25 therethrough. Further, if desired, the upper surface 108 of reveal element 80 may be covered by a decorative material 110 which can be foil, plastic, paint, or numerous other suitable decorative materials. By proper selection of materials, different "looks" can be created wherein coating 110 either matches, complements or contrasts the decorative format of fabric sheets 22 and 24.

The operative attachment of molding strip 20 and reveal element 80 onto a support surface can now be more fully appreciated. After the installer determines the desired placement for the molding strip 20 on surface 11, a suitably sized molding strip 20 is cut and positioned along such boundary. The user then attaches molding strip 20 by affixing flanges 44 and 54, as well as base wall 26, as desired, by means of a plurality of staples, such as staples 56, or other attachment means such as screws, nails or the like so that molding strip 20 is firmly secured onto surface 11. It should be understood that where the installer is covering a support surface, the installer configures molding strips in a framework around the perimeter of the area to be covered. Additional interior molding strips are attached to the support surface and intersect the framework and other interior molding strips in the desired decorative geometry. It is intended that molding strips 20 according to this invention be employed as at least some of the interior pieces and that molding strips such as those disclosed in my application Ser. No. 841,593 or Ser. No. 705,796 be used as framework pieces. However, use of the present invention may be had without employing the molding strips of these other inventions.

After attaching all molding strips, the installer affixes, if desired, various material bats such as bats 112, on the support surface 11 within the framework. Bats 112 may be selected to be thermal insulation materials or accoustical materials. The user then overlays a first sheet of flexible material 22 on first raised support surface 22 so that a marginal edge portion 23 extends into U-shaped channel 78. Marginal edge 23 is then forced into clamping structure 40 by inserting marginal edge 23 between clamping walls 58 and 60. Any suitable straight edged tool, such as a putty knife, may be conveniently used, and, thus, no special insertion tool is required. When the insertion tool is removed, clamping walls 58 and 60, with their respective serrations 64 and 66, firmly retain marginal edge 23 so that it extends upwardly from the clamping structure 40 across first upper side wall portion 38 and then along first raised support wall 32. Fabric sheet 22 is maintained in spaced relation to support surface 11. Similarly, a second flexible sheet 24 may be overlayed on second raised support wall 32 so that its marginal edge portion 25 is oriented within U-shaped channel structure 78. The insertion tool is then used to force marginal edge portion 25 between clamping walls 68 and 70 so that clamping walls 68 and 70 along with their corresponding serrations 74 and 76 retain marginal edge portion 25 therein. Accordingly, marginal edge portion 25 extends upwardly from clamping structure 50, across second upper side wall portion 48 and across second raised support wall 34 so that flexible sheet 24 is maintained in a spaced parallel relation to support surface 11.

After mounting each flexible sheet, it is stretched to other molding strips in the framework or interior and attached thereto so that each sheet is attached to molding strips around the sheet's perimeter. To this end, each sheet is pre-cut to a size geometrically similar to the area to be covered as defined by the boundary of molding strips, but the sheet is sized slightly larger than the area to provide marginal edges to be received by the molding strips. After all sheets are secured to cover the surface 11 within the framework, reveal elements such as reveal element 80 are inserted into each channel structure 78 so that reveal side walls 84 and 86 are locked into position against first and second lower side wall portions 36 and 46 thereby substantially enclosing U-shaped channel structure to present a relatively smooth appearance for the wall covering system yet exposing the decorative reveal surface.

Figure 4:
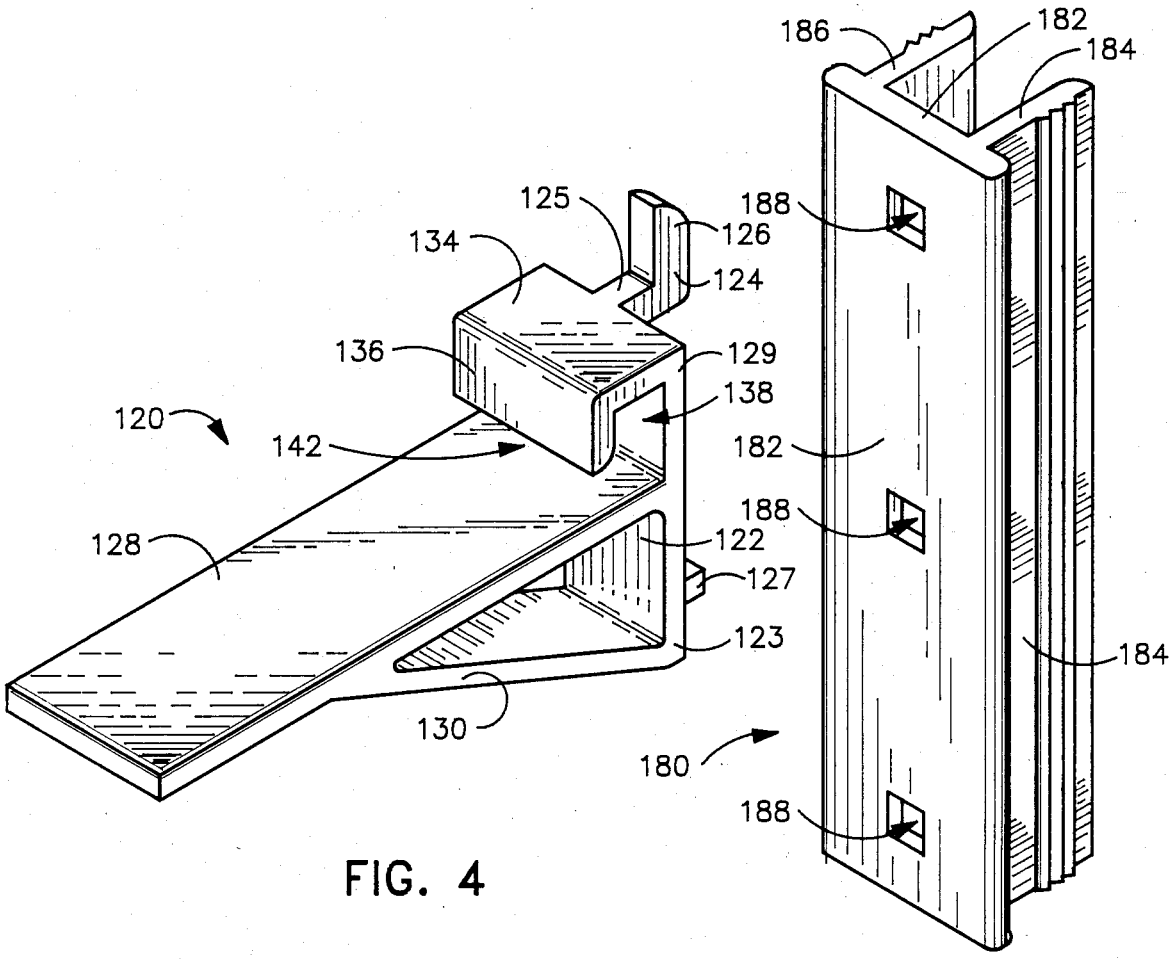
FIG. 4 is a perspective view of a modification of the reveal element having a complimentary shelf bracket adapted for use with the molding strip element shown in FIGS. 2 and 3.

In order to increase the usefulness of the present invention, two shelf and bracket systems are provided which interact with the reveal element in order to provide shelving as part of the wall covering system. A first such bracket system is shown in FIGS. 4 and 5 and includes a reveal element 180 having a top wall 182 and a pair of parallel side walls 184 and 186. Side walls 184 and 186 are positioned perpendicularly to top wall 182 and are in parallel spaced-apart relation a sufficient distance to engage the lower side wall portions 36 and 46 of reveal element 20 in a manner similar to that with respect to reveal element 80. Reveal element 180 differs in construction from reveal element 80 in that its top wall 182 includes a plurality of equally spaced openings 188.

A bracket 120 is provided and includes a flat back wall 122 which has a rearwardly and upwardly projecting L-shaped finger 124 having a lateral portion 125 and an upwardly projecting hook portion 126. A post 127 is spaced from finger 124 a distance equal to the distance between the spacing of openings 188. A flat shelf support wall 128 projects perpendicularly away from back wall 122 opposite the direction of finger 124 and post 127 and is further supported by a cantilever wall 130 extending from a lower edge 123 of back wall 122 to a mid-portion of shelf support wall 128. A shelf retaining member 132 is mounted at upper edge 129 of back plate 122. Shelf retaining member 132 includes a first portion 134 which projects oppositely lateral finger portion 125 parallel to shelf support wall 128 and terminates in a downwardly turned lip 136. Accordingly, shelf retaining member 132 has a channel region 138 which has a channel opening or entryway 142 between the free end of lip 136 and shelf support wall 128.

The attachment of a shelf to support surface 11 by reveal element 180 may now be more thoroughly appreciated with reference to FIG. 5. As is shown in FIG. 5, molding strip 20 is first attached to support surface 11 in the manner described above, and a flexible sheet of material such as sheet 22 is mounted in the manner described above. The installer then inserts reveal 180 into molding strip 20 in a manner similar to that described with respect to reveal element 80. However, since molding strip 180 is required to withstand a greater force in order to support the shelf and shelf bracket, as well as anything placed on the shelf, additional stronger attachment elements such as bolts 146 are placed through top wall 184 of reveal element 180 above and below a pair of openings 188. Bracket 120 is then mounted on reveal element 180 by inserting a hook portion 126 of finger 124 through a selected opening 188 and then pivoting bracket 120 downwardly so that post 127 extends through a second opening 188 with back plate 122 abutting top wall 184 of reveal element 180. In this manner bracket 120 is securely mounted by finger 124 and post 127 against top wall 184.

A shelf 150 has a first edge 152 which terminates in an upwardly turned lip 154 and a second edge 156 which terminates in a downwardly re-curved portion 158. After bracket 120 is attached to reveal element 180, shelf 150 is secured by bracket 120 by inserting lip 154 through entryway 142 into channel region 138, as is shown in phantom in FIG. 5. As lip 154 enters channel 138, shelf 150 is pivoted downwardly so that its lower surface 160 is supported on upper surface 162 of bracket 20 with lip 154 being firmly locked into lip 136 of bracket 120.

A second bracket system according to the present invention is shown in FIGS. 6–11, and it should be appreciated that a modified molding strip 220 is provided. Molding strip 220 is configured similarly to molding strip 20, however, a first raised support wall 222 has a greater width than second raised support wall 224 as is shown in FIG. 11. In use, molding strip 220 is attached horizontally along a support surface, such as support surface 11, by means of staples such as staples 46 passing through flanges 34 and 54, respectively. Molding strip 220 supports first and second flexible sheets 22 and 24 in spaced relation to support surface 11 so that sheets 22 and 24 cover bats 112. A modified reveal element 280 is positioned in U-shaped channel structure 278 of molding strip 220.

As is shown best in FIG. 11, reveal element 280 has first and second reveal side walls 284 and 286 which are connected together by means of a bottom wall 290. Bottom wall 290 is sized for insertion between first and second lower side wall portions 236 and 246 and reveal element 280 is securely and directly affixed to support surface 11 by means of a bolt element 226 provided to resist the increased force on reveal element 280 resulting from shelf 150. Reveal element 280 includes a top wall 282 which projects inwardly of side wall 286, substantially parallel to bottom wall 290. However, top wall 282 does not extend completely across the region between side walls 284 and 286 so that entryway 292 is provided into interior 294 of reveal element 280. Accordingly, top wall 282 forms a downwardly projecting lip adapted to receive lip 154 of shelf 150 similarly to lip 136 of bracket 120.

Prior to the mounting of shelf 150 onto reveal 280, though, a bracket 260 is attached to shelf 150. To this end, it should be appreciated that a shelf 150 could be used with reveal 280 is identical to the shelf used with bracket 120 with shelf 150 having a plurality of elongated openings 162 formed in shelf 150 adjacent lip 154. The longer dimension of each opening 162 runs parallel to lip 154. Bracket 260 is in the form of a right triangle. As is shown best in FIGS. 7 and 8, bracket 260 includes a post 262 near its right angle corner on its longer side with post 262 having a general circular cross-section of a diameter equal to the thickness of bracket 260. A rectangularly shaped plate 264 is formed at the upper end of post 260 with plate 264 having a width equal to the thickness of bracket 260 and a length approximately twice as thick as its width. Plate 264 is sized for passage through openings 162 in shelf 150. Bracket 260 terminates at its apex 266 in a curved nose 268 that is configured to match the recurved inner surface 159 of shelf 150.

Bracket 260 is attached to shelf 150 prior to being mounted onto reveal 280. As is shown in FIG. 9, plate 264 and post 260 are inserted through a selected opening 162 so that, when an upper edge 268 abuts lower surface 160 of shelf 150, post 262 extends completely through shelf 150 thereby allowing rotation of bracket 260 and plate 264 within opening 162. As is shown is FIG. 10, when bracket 260 is pivoted, plate 264 locks shelf 150 between edge 268 and plate 264. Also, as is shown in FIG. 11, this pivotal motion causes nose 268 to engage re-curved portion 158 of shelf 50 so that bracket 260 is secured to shelf 150. Lip 154 is now inserted through entryway 292 and into interior 294 of reveal 280 so that, as the assembly pivots downwardly, edge 270 of bracket 260 rests against elongated first raised support wall 222. To this end, support wall 222 is configured to have a similar width as is the length of edge 270.

According to the foregoing, it should be appreciated that reveal 180 and its associated bracket 120 is adapted for securing shelf 150 by means of a vertically extending molding strip such as molding strip 20. On the other hand, molding strip 220 and reveal element 280 is specifically adapted for positioning a shelf 150 and its associated bracket 260 on a horizontally extending mounting strip such as mounting strip 220.

FIG. 12 shows an alternate embodiment to molding strip 220 but should be appreciated that the present invention contemplates additional physical structures of molding strips that embody the same essential elements as molding strip 20. As is shown in FIG. 12, molding strip 320 has a base wall 326 extending completely across its width and first and second raised support walls 332 and 334 oriented in spaced, substantially parallel relationship to base wall 326 along its outer edge. Outer support walls or side walls 342 and 352 interconnect and support raised support walls 332 and 334, respectively. A U-shaped channel region 378 is located internally of raised support walls 332 and 334 and is defined by a central portion of base wall 326 and first and second interior side walls. First interior side wall is defined by a first lower side wall portion 336 and a first upper side wall portion 338 and the second interior side wall is defined by a second lower side wall portion 346 and a second upper side wall portion 348. A first pair of clamping walls are located between the first upper and lower side wall portions. This first pair includes clamping wall 358 attached to lower side wall portion 336 and clamping wall 360 attached to a lower end of first upper side wall portion 338 to define a first clamping structure to retain a flexible sheet of material therebetween. Similarly, a clamping wall 368 is located at the upper end of second lower side wall portion 346 and a clamping wall 370 is located at a lower end of second upper side wall portion 348 to define a second clamping structure on the second interior side wall in order to retain a flexible sheet of material. It should be understood that clamping wall 358 and 360 abut one another and are provided with mating serrations in a manner similar to clamping walls 50 and 60 of the preferred embodiment of the present invention. Likewise, clamping walls 368 and 370 are in abutting relation and are provided with mating serrations in a manner similar to clamping walls 68 and 70 of molding strip 20.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A molding strip assembly adapted to secure flexible sheets of material to a support surface to which the molding strip is attached, comprising:

a base wall adapted to be positioned against said support surface;

a first raised support wall operatively connected to said base wall so that said first support wall is laterally offset at a first side of said base wall and is supported in spaced relation above said support surface;

a second raised support wall operatively connected to said base wall so that said second support wall is laterally offset at a second side of said base wall and is supported in spaced relation above said support surface;

first material retaining means located between said first support wall and said first side along a first interior sidewall, said first material retaining means for receiving and retaining a marginal edge portion of a first sheet of flexible material whereby said first sheet may be secured in the first retaining means and may be trained across and be supported by said first support wall above said support surface; and second material retaining means located between said second support wall and said second side along a second interior sidewall, said second material retaining means for receiving and retaining a marginal edge portion of a second sheet of flexible material whereby said second sheet may be secured in the second retaining means and may be trained across and be supported by said second support wall above said support surface said first and second interior sidewalls spaced apart from one another and forming an open U-shaped channel structure with said base wall defining a bottom wall of said channel structure.

2. A molding strip assembly according to claim 1 wherein said first retaining means including a first pair of clamping walls resiliently biased together whereby the marginal edge portion of said first sheet may be forced between the first pair of clamping walls, and said second retaining means including a second pair of clamping walls resiliently biased together whereby the marginal edge portion of said second sheet may be forced between the second pair of clamping walls.

3. A molding strip assembly according to claim 2 wherein said clamping wall has serrations facing and mating with serrations on a corresponding clamping wall of its respective pair.

4. A molding strip assembly according to claim 2 including a first lower sidewall portion interconnecting the first side of said base wall and a first lower clamping wall and a first upper side wall portion interconnecting a first upper clamping wall and said first support wall, said first upper and lower clamping walls defining the first pair of clamping walls, and including a second lower sidewall portion interconnecting the second side of said base wall and a first lower clamping wall and a second upper sidewall portion interconnecting a second upper clamping wall and said second support wall, said second upper and lower clamping walls defining the second pair of clamping walls.

5. A molding strip assembly according to claim 4 wherein said first lower and upper sidewall portions define said first interior sidewall and wherein said second lower and upper sidewall portions define said second interior sidewall, and including a first exterior sidewall connected to said first support wall and extending downwardly therefrom in spaced relation to said first interior sidewall to terminate at a first exterior sidewall to terminate at a first exterior sidewall edge location generally in the plane of said base wall and a second exterior sidewall connected to said second support wall and extending downwardly therefrom in spaced relation to said second interior sidewall to terminate at a second exterior sidewall edge location generally in the plane of said base wall.

6. A molding strip assembly according to claim 5 including first and second mounting flanges extending laterally away from said first and second sidewalls, respectively, and away from said U-shaped channel structure, said first and second mounting flanges oriented generally in the plane of said base wall.

7. A molding strip assembly according to claim 5 including a reveal element matably received in said U-shaped channel structure, said reveal element having first and second reveal sidewall portions respectively engaging said first and second interior sidewalls to be retained thereby.

8. A molding strip assembly according to claim 7 wherein said first reveal sidewall portion and said first interior sidewall have facing complementary first side wall serrations engageable with one another and wherein said second reveal sidewall portion and said second interior sidewall have facing complementary second side wall serrations engageable with one another.

9. A molding strip assembly according to claim 8 wherein the complementary serrations on the first and second interior sidewalls are formed respectively on said first and second lower sidewall portions.

10. A molding strip assembly according to claim 7 wherein said reveal element has a bottom wall extending between and interconnecting said first and second reveal sidewall portions and a top wall extending from one of said first and second reveal sidewall portions toward the other to define a reveal lip, and including a shelf having a shelf lip insertable into said reveal element and engaging said reveal lip, and a bracket secured to said shelf and having a support edge supporting a lower surface of the shelf with a back edge of said bracket bearing against said first support wall.

11. A molding strip assembly according to claim 10 wherein a second half edge opposite said hooked edge is re-curved to engage a nose of said bracket.

12. A molding strip assembly according to claim 11 wherein said first support wall is wider than said second support wall.

13. A molding strip assembly according to claim 7 wherein said reveal element includes a top wall extending between upper edge portions of said first and second reveal sidewalls so that said top wall substantially encloses said U-shaped channel structure.

14. A molding strip assembly according to claim 13 wherein said top wall, said first support wall and said second support wall are located in a common plane.

15. A molding strip assembly according to claim 13 wherein said first and second upper sidewall portions are spaced apart from one another a distance greater than the distance between said first and second lower sidewall portions.

16. A molding strip assembly according to claim 13 wherein said top wall is covered by a decorative material.

17. A molding strip assembly according to claim 13 wherein the top wall of said reveal element has a plurality of spaced openings formed therein, and including a shelf and a bracket, said bracket having a back plate with mounting elements sized and spaced for mated insertion into the openings in said top wall, said bracket having a support arm projecting away from said back plate and operative to support said shelf.

18. A molding strip assembly according to claim 17 wherein said bracket has a retaining structure including a downwardly projecting hooked lip, said shelf having a shelf lip adapted to engage said hooked lip when the shelf is supported by said bracket.

19. In a surface covering system wherein a framework of outer molding strips are used to create a framework around an area on the surface to be covered, said outer molding strips operative to secure, at the perimeter of the area, perimeter marginal edges of a flexible covering extending across said area, said flexible covering having several sections at least some of which have facing interior marginal edges unsecured by said outer molding strips, the improvement comprising an inner molding strip secureable to said surface within said area and having a base wall adjacent said surface, first and second raised support walls operatively connected to said base wall and positioned in spaced relation to said surface, said first raised support wall being on one lateral side of said base wall and said second raised support wall being on the other lateral side of said base wall, said first raised support wall having a first edge facing a second edge on said second raised support wall, a first interior side wall extending between said first raised support wall and said base wall, a second interior side wall extending between said second raised support wall and said base wall and spaced-apart from said first side wall, said base wall and said first and second side walls defining an open U-shaped channel having an opening between said first and second edges, first material retaining means associated with said first interior side wall for receiving said retaining one of said interior facing marginal edges of a first one of said sections, and second material retaining means associated with said second interior side wall for receiving and retaining another of said interior facing marginal edges; and a reveal element adapted to be positioned and retained in said channel and having a top wall extending across said opening when said reveal element is positioned in the channel.

20. The improvement according to claim 19 including a first exterior side wall extending downwardly from said first support wall on the side of said first interior side wall opposite said channel, said first interior side wall extending downwardly to a location substantially in the plane of said base wall and the outwardly to define a first flange adapted to attach said molding strip to said support surface, and including a second exterior side wall extending downwardly from said second raised support wall on the side of said second interior side wall opposite said channel, said second exterior side wall extending downwardly to a location generally in the plane of said base wall and then outwardly to define a second flange adapted to attach said molding strip to said support surface.

21. The improvement according to claim 19 wherein the top wall of said reveal element has a plurality of spaced openings formed therein, and including a shelf and a bracket, said bracket having a back plate with mounting elements sized and spaced for mated insertion into some of the openings in said top wall, said bracket having a support arm projecting away from said back plate and operative to support said shelf, said bracket including a retaining structure extending away from said back plate in a common direction with said support arm, said retaining structure including a hooked lip projecting toward said support arm, said shelf having a shelf lip adapted to engage said hooked lip when shelf is supported by said bracket.

22. The improvement according to claim 19 wherein said top wall is covered by a decorative material.

23. The improvement according to claim 19 wherein said reveal element has a bottom wall extending between and interconnecting said first and second reveal side wall portions, said top wall extending from one of said first and second reveal side wall portions toward the other to define a reveal lip, and including a shelf having a shelf lip insertable into said reveal element and engaging said reveal lip, and a bracket connectable to said shelf and having a support edge supporting a lower surface of the shelf with a back edge of said bracket bearing against said first support wall when said shelf lip engages said reveal lip.

24. The improvement according to claim 23 wherein a second shelf edge opposite said hooked edge is re-curved to engage a nose of said bracket.

25. The improvement according to claim 19 wherein said first material retaining means includes a first pair of clamping walls resiliently biased together whereby the marginal edge portion of said one interior facing marginal edge may be forced between the first pair of clamping walls, and said second retaining means including a second pair of clamping walls resiliently biased together whereby the marginal edge portion of the other said interior facing marginal edge is forced between the second pair of clamping walls.

26. The improvement according to claim 25 wherein each clamping wall has serrations facing and mating with serrations on a corresponding clamping wall of its respective pair.

27. The improvement according to claim 25 wherein said first interior side wall is defined by a first lower side wall portion extending upwardly from said base wall and supporting a first lower clamping wall and a first upper side wall portion extending downwardly from said first raised support wall and supporting a first upper clamping wall, said first lower clamping wall and said first upper clamping wall defining said first pair of clamping walls, and wherein said second interior side wall includes a second lower side wall portion extending upwardly from said base wall and supporting a second lower clamping wall and a second upper side wall portion extending downwardly from said second raised support wall and supporting a second upper clamping wall, said second lower clamping wall and said second upper clamping wall defining said second pair of clamping walls.

28. The improvement according to claim 27 wherein said first upper and lower clamping walls are positioned at an acute angle with respect to said base wall and including a first arcuate wall portion interconnecting said first upper and lower clamping walls along an edge thereof opposite said channel, and wherein said second upper and lower clamping walls are formed at an acute angle with respect to said base wall and are interconnected by a second arcuate wall portion at an edge thereof opposite said channel.

* * * * *